US006431972B1

(12) United States Patent
Folsom

(10) Patent No.: US 6,431,972 B1
(45) Date of Patent: Aug. 13, 2002

(54) MULTIPLE PLUMBING VENT APPARATUS

(75) Inventor: William D. Folsom, Houston, TX (US)

(73) Assignee: Hy-Tech Inventions, Inc., Spring, TX (US)

( * ) Notice: Subject to any disclaimer, the term of this patent is extended or adjusted under 35 U.S.C. 154(b) by 0 days.

(21) Appl. No.: 09/929,954

(22) Filed: Aug. 15, 2001

(51) Int. Cl.[7] ..... F24F 7/02
(52) U.S. Cl. ..... 454/18; 4/211; 4/218; 454/365; 454/366
(58) Field of Search ..... 454/3, 18, 19, 454/35, 364, 365, 366, 367, 368; 4/211, 218

(56) References Cited

U.S. PATENT DOCUMENTS 1,427,107 A * 8/1922 Kaplan ..... 285/129.1
5,390,451 A 2/1995 Kopp et al.
5,394,663 A 3/1995 Jackson
5,890,960 A 4/1999 Cronan et al.

* cited by examiner

*Primary Examiner*—Harold Joyce
(74) *Attorney, Agent, or Firm*—Mary J. Gaskin

(57) ABSTRACT

An apparatus for venting several plumbing pipes through existing roof openings made for existing ventilation systems, including turbine ventilators, roof ventilators, ridge ventilators and hip ventilators. The plumbing vent apparatus has two sides, a bottom and two removable end caps. End caps for use with a ridge ventilator or hip ventilator have slots for fitting around the ridge rafter. The apparatus is mounted in the roof opening made for the ventilation system, which is installed above it. When used with a ventilation system which has a ridge or hip rafter, the apparatus can be configured to have mounting flanges along the top of the sides for attachment to the roof decking, or can have mounting flanges along the slots on the end caps for attachment to the rafter. Each male adapter, which is inserted through an opening in the bottom of the apparatus, can hold the venting end of a PVC plumbing pipe. Removable covers are placed into unused openings. Methane and sewer gasses are vented from the plumbing vent apparatus and out through the roof ventilator.

14 Claims, 6 Drawing Sheets

MULTIPLE PLUMBING VENT APPARATUS

FIELD OF THE INVENTION

This invention relates to venting plumbing systems, and, more specifically, to an apparatus for venting plumbing pipes through the roof of a building using existing ventilation structures.

BACKGROUND OF THE INVENTION

In building structures, it is well known that plumbing systems must be vented to the outside in order to prevent methane and sewer gas from escaping into the interior of the structure. Presently, openings are cut through the roof of the structure in order to vent plumbing fixtures, thereby damaging the structural integrity of the roof. Typically, each venting pipe requires its own opening. A plumber may have to cut as many as ten to twenty holes in the roof of a building in order to properly vent the plumbing system. Each opening presents the possibility of a future leak in the roof around the upstanding pipe. Plumbers must use various seals, gaskets, and flashing in order to prevent the occurrence of a leak. Finally, the appearance of numerous pipe vents in a roof can be quite unattractive.

SUMMARY OF THE INVENTION

The present invention enables plumbers to utilize pre-existing ventilation systems in order to vent plumbing fixtures.

Currently, several different ventilation systems are used to remove heat from the attic of a building. Turbine ventilators, roof ventilators, ridge ventilators, and hip ventilators work well because they are mounted on the roof above the attic, often near or at the highest point of a building. The present invention provides an apparatus to which multiple plumbing vents can be attached in order to vent them. The plumbing vent apparatus can be mounted under any of the several presently-used roof ventilators, allowing methane and sewer gases to exhaust out of the plumbing vents, through the plumbing vent apparatus, and out the roof ventilator. Using the plumbing vent apparatus obviates the need to cut additional holes in the roof to vent plumbing systems. No modifications must be made, either to the roof or to the ventilators.

The plumbing vent apparatus of the present invention consists of a body with two sides, a bottom and two end caps, which may be removable. The apparatus can be preassembled prior to installation. When the apparatus will be used with a ridge ventilator or a hip ventilator, each end cap has a slot which is fitted around the ridge rafter or hip rafter. A plumber installs the body of the plumbing vent apparatus in the roof opening made for the ventilation system. Mounting flanges on the top of the two sides are nailed to the roof decking. The turned edges of end caps are inserted into channels or grooves on the body, thereby enclosing the body. The venting system is then installed over the plumbing vent apparatus. For each plumbing pipe to be vented, a polyvinylchloride (PVC) male adapter has been screwed into a hole in the bottom side of the plumbing vent apparatus. The end of the plumbing pipe, also made from PVC, is glued into the other end of the adapter. Covers are placed into unused openings in the plumbing vent apparatus; the covers are removable for later use. Methane and sewer gases are vented from the plumbing pipes through the plumbing vent apparatus and out through the roof ventilator. Finally, an alternate embodiment is disclosed for mounting the apparatus onto a ridge rafter or hip rafter.

It is an object of the present invention to provide an apparatus for ventilating the plumbing system of a structure without making additional holes in a roof.

Yet another object of the present invention is to provide an apparatus for consolidating several plumbing vents and venting them out of the roof at one location.

Still another object of the present invention is to provide an apparatus that can be used with the presently-existing roof ventilator systems, with no modifications to the roof ventilator or to the roof.

A further object of the present invention is to provide a plumbing vent apparatus which is easy to fabricate and to install.

A still further object of the present invention is to provide a plumbing vent apparatus which functions with code-approved materials.

DESCRIPTION OF PREFERRED EMBODIMENT

Figure 1:
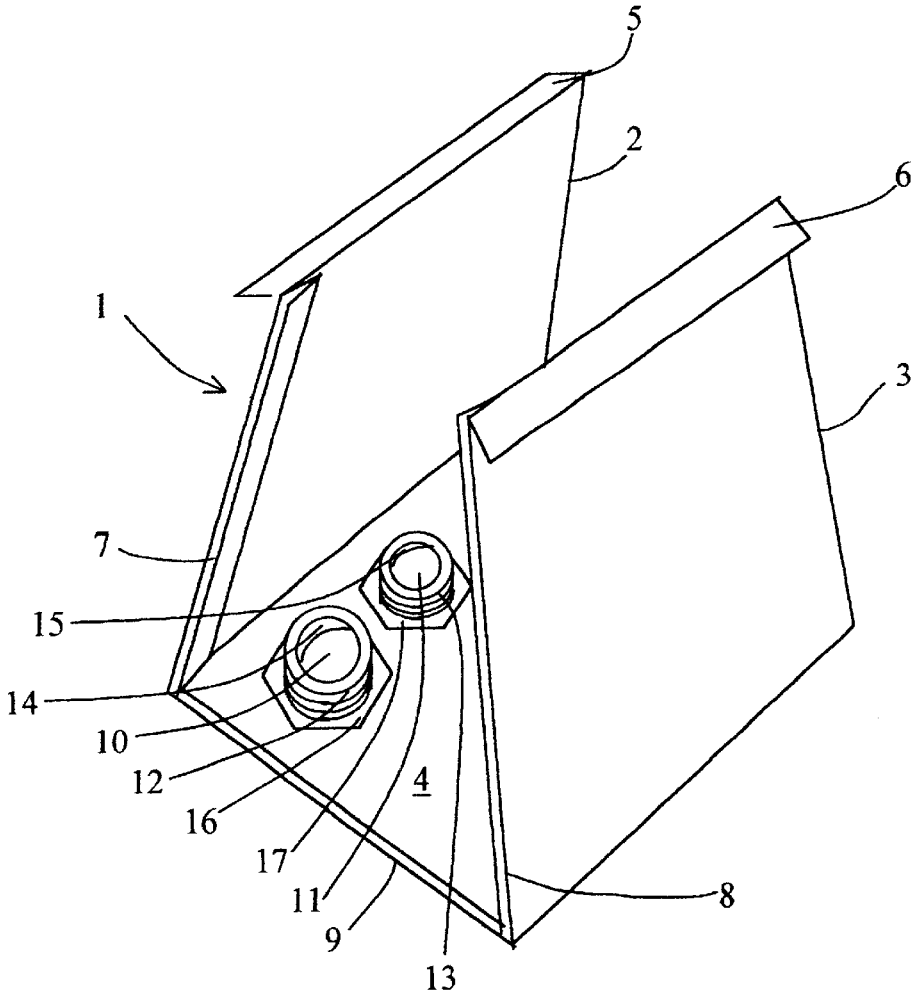
FIG. 1 is a perspective view of the body of the plumbing vent apparatus.

The multiple plumbing vent apparatus of the present invention is made from galvanized sheet metal or molded plastic, such as an injection-molded thermoplastic compound. The body 1 of the apparatus is shown in FIG. 1, comprising two sides 2, 3 and a bottom 4, with mounting flanges 5, 6 along the tops of the sides 2, 3, and channels 7, 8, 9 along the edges of the sides 2, 3 and bottom 4 (channels on the opposite edges can not be seen). Several circular openings 10, 11 are fabricated in the bottom 4. Threaded ends 12, 13 of male adapters 14, 15, made from polyvinylchloride (PVC) pipe, are inserted into the openings 10, 11, and lock nuts 16, 17 are screwed onto the threaded ends 12,13 in order to secure the adapters 14, 15 to the bottom 4 on the body 1 of the apparatus.

Figure 2:
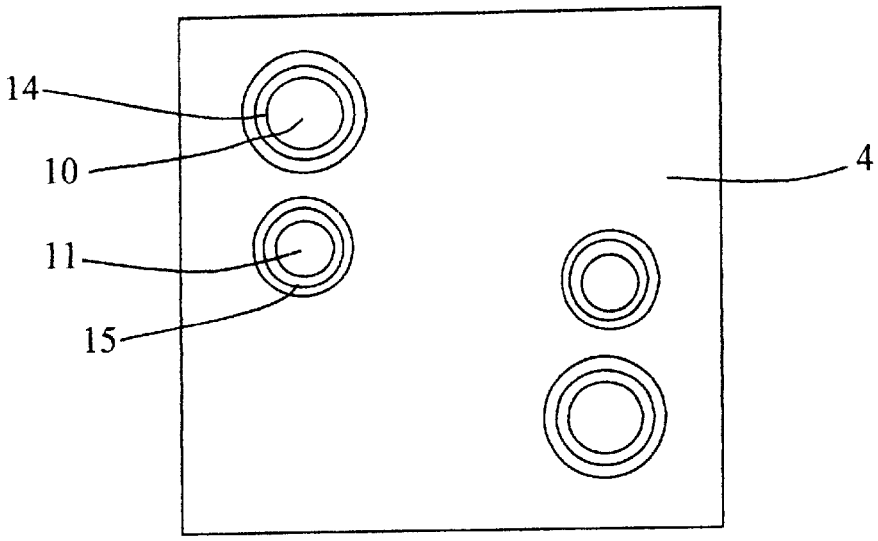
FIG. 2 is a bottom view of the body of the plumbing vent apparatus.

The rectangular bottom 4 of the body 1 is shown in FIG. 2. Male adapters 14, 15 have been threaded into openings 10, 11.

Figure 3:
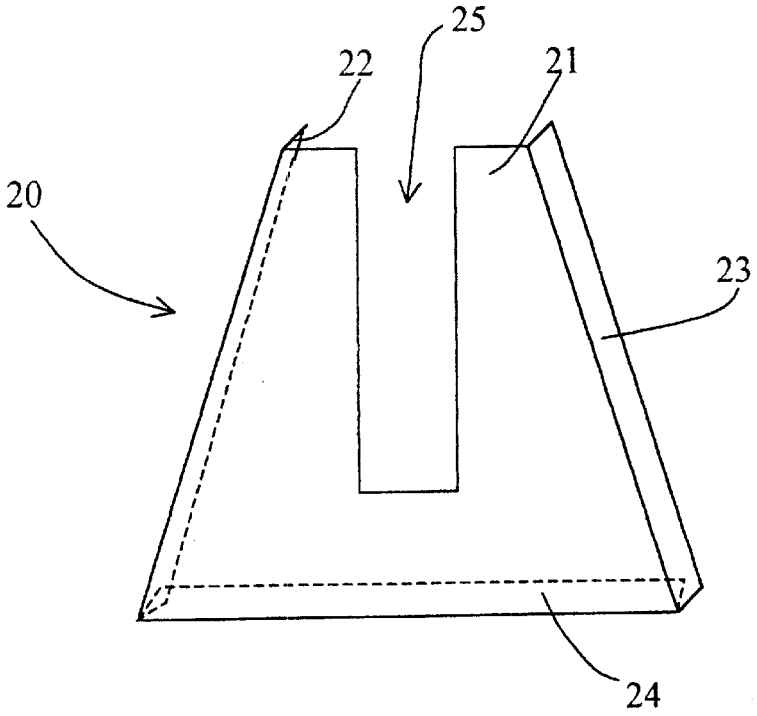
FIG. 3 is a plan view of one of the two identical end caps used with the body of a plumbing vent apparatus which is installed under a ridge ventilator or hip ventilator system.

FIG. 3 shows one of the two identical end caps 20 which are installed on the body 1 of the apparatus when the multiple plumbing vent apparatus is used with either a ridge ventilator or a hip ventilator. The end cap 20 has a flat portion 21, with turned edges 22, 23, 24 extending perpendicularly thereto. The turned edges 22, 23, 24 of each end cap 20 can be inserted into the corresponding channels 7, 8, 9 on each side 2, 3 and bottom 4 of the body 1 of the apparatus in order to complete the enclosure and to trap gasses exhausted from the openings 10,11 (shown in FIG. 2). A slot 25 is cut into the flat portion 21 of the end cap 20 in order to allow the apparatus to fit around a ridge rafter or hip rafter (shown in FIG. 4).

Figure 4:
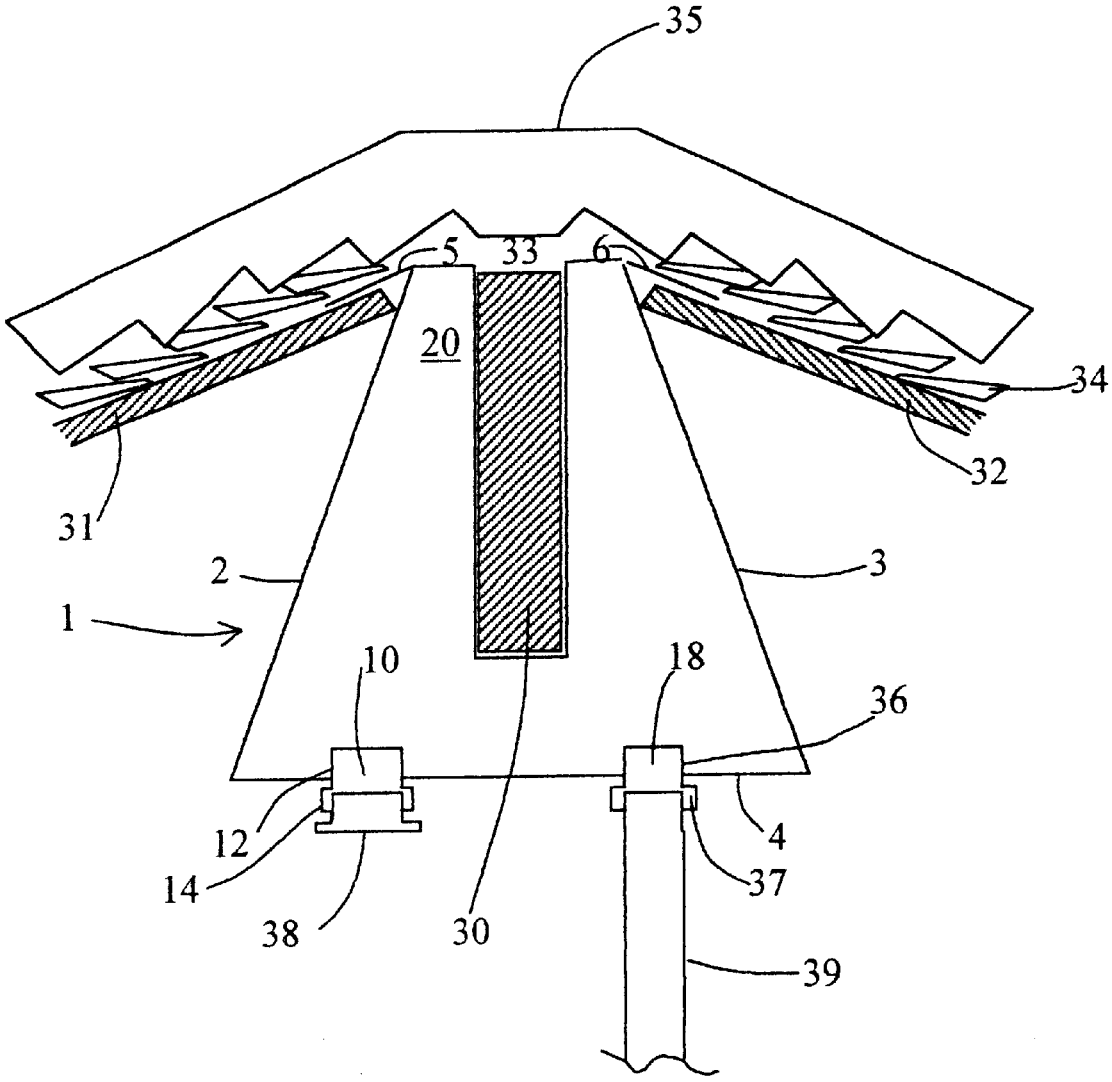
FIG. 4 is a cross-sectional view of a plumbing vent apparatus which has been installed under a ridge ventilator system.

In FIG. 4, the body 1 of the apparatus has been mounted under a ridge ventilator 35. The end caps 20 of the apparatus are designed to fit around the ridge rafter 30 and can be installed without damaging it in any way. The mounting flanges 5, 6 on the top of sides 2, 3 of the body 1 are laid over the decking 31, 32 on each side of the ridge vent opening 33. Roof tacks (not shown) are used to attach the mounting flanges 5, 6 to the decking 31, 32. Shingles 34 are installed over the decking 31, 32. and over the mounting flanges 5, 6, in a conventional manner. The ridge ventilator 35 is then installed over the ridge vent opening 33 and the shingles 34. Threaded ends 12, 36 of male adapters 14, 37 are screwed into place in the openings 10, 18 in the bottom 4. If no pipe will be installed in an adapter, the plumber will push a cap 38 into the male adapter 14 in order to seal the opening 10. To connect a venting system to the apparatus, the exhaust end of a PVC pipe 39 is glued into the male adapter 37, creating an air-tight fit. Gasses are vented from the pipe 39 into the body 1 of the adapter through opening 18. The gasses then vent out the ridge vent opening through the ridge ventilator 35.

Figure 5:
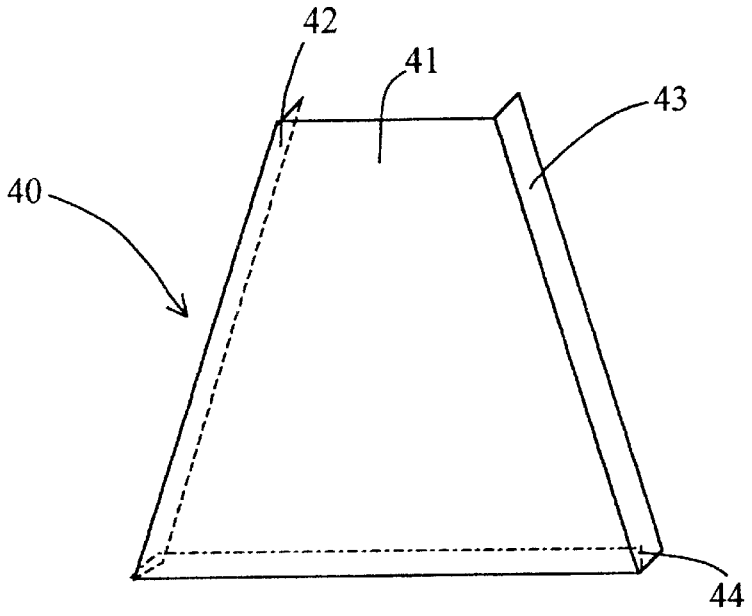
FIG. 5 is a plan view of one of the two identical end caps used with the body of a plumbing vent apparatus which is installed under a roof ventilator or turbine ventilator.

FIG. 5 shows one of the two identical end caps 40 which are installed on the body 1 of the apparatus when the multiple plumbing vent apparatus is used with a roof ventilator or turbine ventilator. The end cap 40 has a flat portion 41, with turned edges 42, 43, 44 extending perpendicular thereto. The turned edges 42, 43, 44 of each end cap 40 can be inserted into the corresponding channels 7, 8, 9 on both sides of the body 1 of the apparatus in order to complete the enclosure and to trap gasses exhausted from the openings 10, 11 (shown in FIG. 2).

Figure 6:
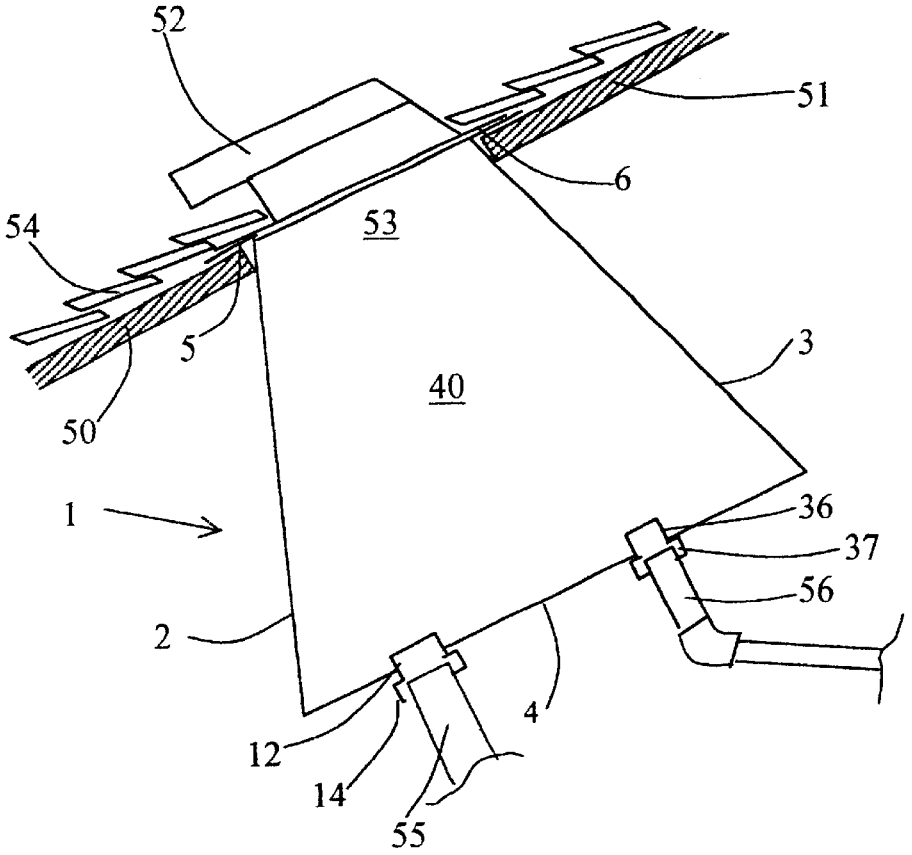
FIG. 6 is a cross-sectional view of a plumbing vent apparatus which has been installed under a roof ventilator system.

In FIG. 6, the body 1 of the apparatus, with end caps 40 installed, has been mounted under a roof ventilator 52. The mounting flanges 5, 6 on the sides 2, 3 of the body 1 are laid over the decking 50, 51 on each side of the roof opening 52. Roof tacks are used to attach the mounting flanges 5, 6 to the decking 50, 51. The roof ventilator 52 is then installed over the roof opening 53 in a conventional manner, and shingles 54 are then laid. Threaded ends 12, 36 of male adapters 14, 37 are screwed into place. Exhaust ends of PVC pipes 55, 56 are glued into male adapters 14, 37, creating air-tight fits.

Figure 7:
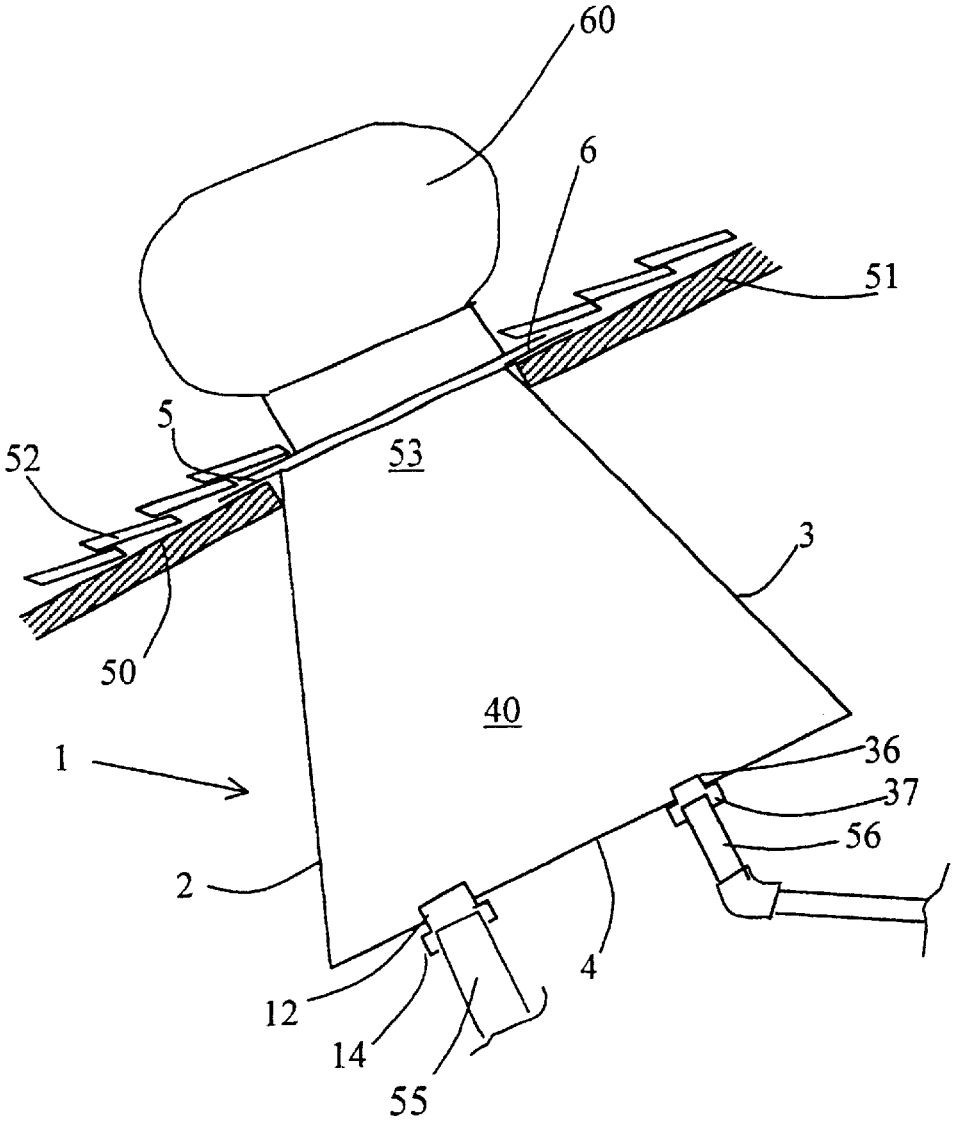
FIG. 7 is a cross-sectional view of a plumbing vent apparatus which has been installed under a turbine ventilator system.

In FIG. 7, the body 1 of the apparatus, with end caps 40 installed, has been mounted under a turbine 60. The mounting flanges 5, 6 on the sides 2, 3 of the body 1 are laid over the roof opening 53. Roof tacks are used to attach the mounting flanges 5, 6 to the decking 50, 51. The turbine 60 is then installed over the roof opening 53 in a conventional manner, and shingles 54 are then laid. Threaded ends 12, 36 of male adapters 14, 37 are screwed into place. Exhaust ends of PVC pipes 55, 56 are glued into male adapters 14, 37, creating air-tight fits.

Figure 8:
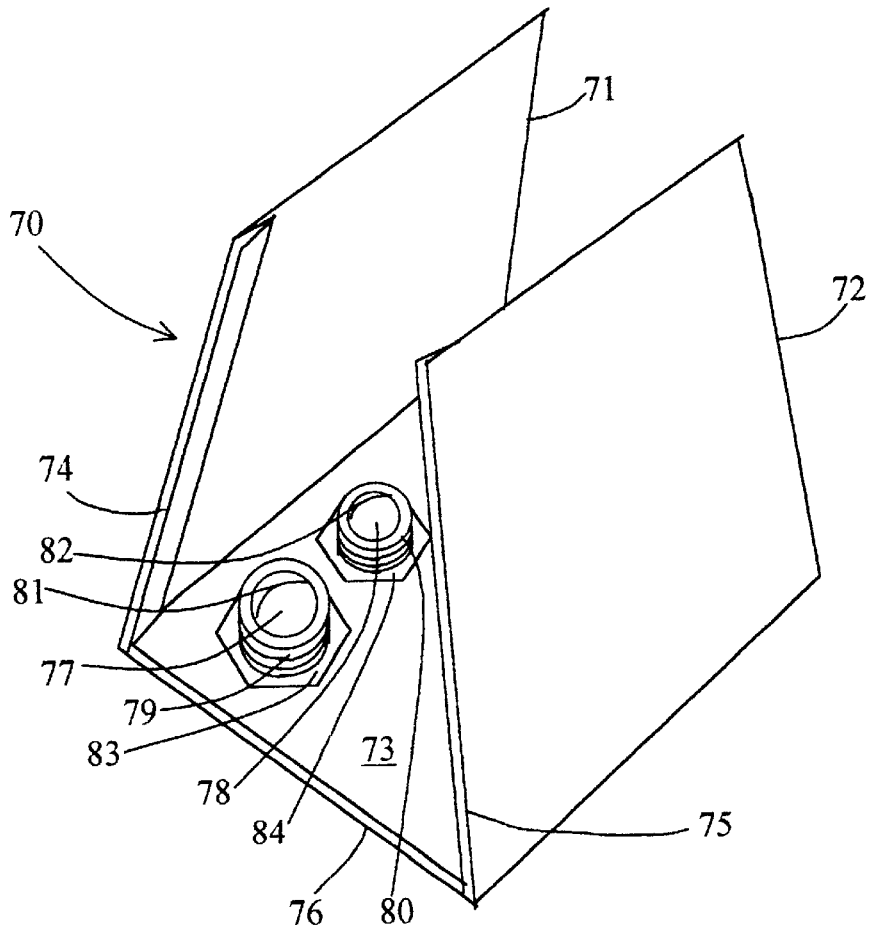
FIG. 8 is a perspective view of the body of a plumbing vent apparatus which can be mounted onto a ridge rafter or a hip rafter.

FIG. 8 shows the body 70 of an alternative embodiment of the apparatus, which can be mounted onto a ridge rafter or a hip rafter. The apparatus can be used when a roof is already in place, or if a plumber wishes to install it without involving the roofer. The body 70 comprises two sides 71, 72, and a bottom 73, with channels 74, 75, 76, along the edges of the sides 71, 72, and bottom 73 (channels on the opposite edges cannot be seen). Several circular openings 77, 78 are fabricated in the bottom 73. Threaded ends 79, 80 of male adapters made from PVC pipe are inserted into the openings 77, 78, and lock nuts 83, 84 are screwed onto the threaded ends 79, 80 in order to secure the adapters 81, 82 to the bottom 73 of the body 70 of the apparatus.

Figure 9:
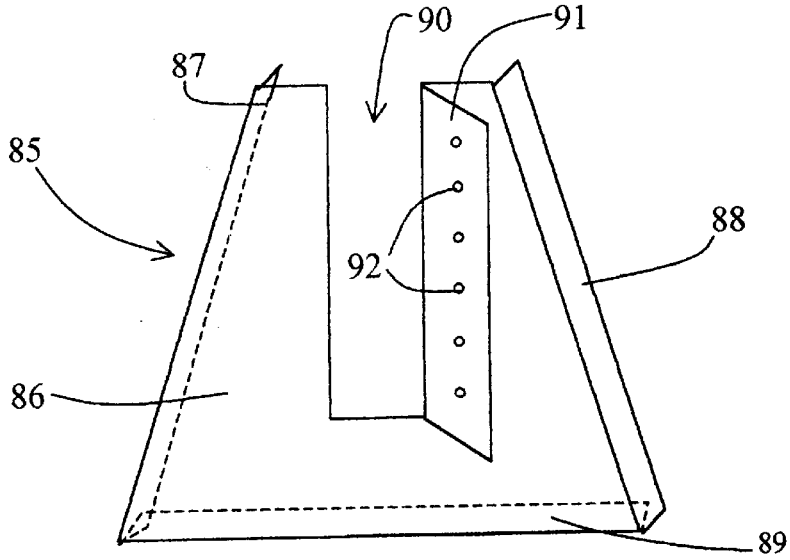
FIG. 9 is a plan view of one of the two identical end caps used to mount a plumbing vent apparatus onto a ridge rafter or a hip rafter.

FIG. 9 shows one of the two identical end caps 85 which are installed on the body 70 of the alternate embodiment of the apparatus when the multiple plumbing vent apparatus will be used with ridge ventilators or hip ventilators. The end cap 85 has a flat portion 86, with turned edges 87, 88, 89 extending perpendicularly thereto. The turned edges 87, 88, 89 of each end cap 85 can be inserted into the corresponding channels 74, 75, 76 on each side 71, 72 and bottom 73 of the body 70 of the apparatus in order to complete the enclosure. A slot 90 is cut into the flat portion 86 of the end cap 85 in order to allow the apparatus to fit around a ridge rafter or hip rafter. Along one side of the slot 90 is a side mounting flange 91, which is turned perpendicular to the flat portion 86 of the end cap 85. To install the apparatus, a plumber uses nails to attach the side mounting flange 91 to the side of a ridge rafter or hip rafter (shown in FIG. 4). Optional nail holes 92 can be fabricated in the side mounting flange 91 to simplify installation of the apparatus.

Although the invention has been described with reference to several preferred embodiments, it will be understood by those skilled in the art that additions, modifications, substitutions, deletions and other changes not specifically described are possible, and that the details herein are to be interpreted as illustrative and not as self-limiting.

I claim:

1. An apparatus for venting at least one plumbing pipe through a ridge vent installed over a structure's ridge rafter comprising:

a body member having a generally u-shaped configuration comprising:

a rectangular bottom with at least one circular opening cut therein, said bottom having four edges with a channel formed in each of the first and the second edges;

a rectangular first side having four edges with a channel formed in each of the second and the fourth edges, the first edge being attached to the second edge of the bottom, and the third edge being folded generally perpendicularly to the first side to form a first mounting flange;

a rectangular second side having four edges with a channel formed in each of the second and the fourth edges, the first edge being attached to the fourth edge of the bottom, and the third edge being folded generally perpendicularly to the second side to form a second mounting flange;

at least one cylindrical male adapter having a first end configured to accommodate an end of the plumbing pipe for venting, and further having a second end inserted into the opening in the bottom and affixed thereto;

two flat generally trapezoid-shaped end panels, each having four edges, three of the edges having a rim projecting perpendicularly therefrom, each rim being inserted into one of the complementary channels in the edges of the bottom, the first side and the second side, and the fourth edge having a rectangular slot configured for fitting around the ridge rafter.

2. The apparatus of claim 1 wherein the second end of the male adapter has an outer surface with threads, and further comprising a lock nut for affixing the male adapter to the bottom of the body member.

3. The apparatus of claim 1 which further comprises a removable cylindrical cover for closing the first end of the male adapter.

4. An apparatus for venting at least one plumbing pipe through a roof vent installed over an opening in a roof comprising:

a body member having a generally u-shaped configuration comprising:

a rectangular bottom with at least one circular opening cut therein, said bottom having four edges with a channel formed in each of the first and the second edges;

a rectangular first side having four edges with a channel formed in each of the second and the fourth edges, the first edge being attached to the second edge of the bottom, and the third edge being folded generally perpendicularly to the first side to form a first mounting flange;

a rectangular second side having four edges with a channel formed in each of the second and the fourth edges, the first edge being attached to the fourth edge of the bottom, and the third edge being folded generally perpendicularly to the second side to form a second mounting flange;

at least one cylindrical male adapter having a first end configured to accommodate an end of the plumbing pipe for venting, and further having a second end inserted into the opening in the bottom and affixed thereto;

two flat generally trapezoid-shaped end panels, each having four edges, three of the edges having a rim projecting perpendicularly therefrom, each rim being inserted into one of the complementary channels in the edges of the bottom, the first side and the second side.

5. The apparatus of claim 4 wherein the second end of the male adapter has an outer surface with threads, and further comprising a lock nut for affixing the male adapter to the bottom of the body member.

6. The apparatus of claim 4 which further comprises a removable cylindrical cover for closing the first end of the male adapter.

7. An apparatus for venting at least one plumbing pipe through a ridge vent installed over a structure's ridge rafter comprising:

a body member having a generally u-shaped configuration comprising:

a rectangular bottom with at least one circular opening cut therein, said bottom having four edges with a channel formed in each of the first and the second edges;

a rectangular first side having four edges with a channel formed in each of the second and the fourth edges, the first edge being attached to the second edge of the bottom;

a rectangular second side having four edges with a channel formed in each of the second and the fourth edges, the first edge being attached to the fourth edge of the bottom;

at least one cylindrical male adapter having a first end configured to accommodate an end of the plumbing pipe for venting, and further having a second end inserted into the opening in the bottom and affixed thereto;

two flat generally trapezoid-shaped end panels, each having four edges, three of the edges having a rim projecting perpendicularly therefrom, each rim being inserted into one of the complementary channels in the edges of the bottom, the first side and the second side, and the fourth edge having a rectangular slot configured for fitting around the ridge rafter, the slot having a mounting flange extending perpendicularly thereto along a side.

8. The apparatus of claim 7 wherein the second end of the male adapter has an outer surface with threads, and further comprising a lock nut for affixing the male adapter to the bottom of the body member.

9. The apparatus of claim 7 which further comprises a removable cylindrical cover for closing the first end of the male adapter.

10. A method for venting at least one plumbing pipe through a structure's ventilation system comprising the steps of:

providing a generally cubical body member having a bottom with at least one opening, four sides, and mounting flanges;

affixing a male adapter in each of the openings in the bottom of the body member;

installing the body member by attaching the mounting flanges to roof decking along an opening in a roof;

installing the ventilation system above the body member; and attaching a venting end of a plumbing pipe to the male adapter.

11. The method of claim 10 wherein the ventilation system is selected from a turbine vent and a roof vent.

12. The method of claim 10 wherein the ventilation system is a ridge vent installed over a ridge rafter, and wherein the body member has a slot configured to allow the body member to fit around the ridge rafter.

13. A method for venting at least one plumbing pipe through a ventilation system installed over a rafter comprising the steps of:

providing a generally cubical body member having a bottom with at least one opening, four sides, and mounting flanges, said body member further having a slot configured to allow the body member to fit around the ridge rafter;

affixing a male adapter in each of the openings in the bottom of the body member;

installing the body member under the ventilation system by attaching the mounting flanges to the rafter; and attaching a venting end of a plumbing pipe to the male adapter.

14. The method of claim 13 wherein the rafter is selected from a ridge rafter or a hip rafter.

* * * * *